United States Patent [19]

Goetjen

[11] 4,022,556

[45] May 10, 1977

[54] CONCRETE SLAB EXTRUDER HAVING A FREE FLIGHT AUGER

[75] Inventor: Ted G. Goetjen, Silver Spring, Md.

[73] Assignee: The George Hyman Construction Company, Bethesda, Md.

[22] Filed: Apr. 30, 1975

[21] Appl. No.: 573,327

[52] U.S. Cl. ..... 425/64; 425/207; 425/209; 425/219; 425/432

[51] Int. Cl.[2] ..... B28B 13/02

[58] Field of Search ..... 425/59, 63–65, 425/219, 432, 456, 207, 209; 264/33, 34

[56] References Cited

UNITED STATES PATENTS

| | | | |
|---|---|---|---|
| 2,406,025 | 8/1946 | Moor | 425/59 |
| 3,143,782 | 8/1964 | Kalns | 425/432 |
| 3,159,897 | 12/1964 | Ellis et al. | 425/432 |
| 3,284,867 | 11/1966 | Booth | 425/114 |
| 3,781,154 | 12/1973 | Herbert et al. | 425/64 |
| 3,877,860 | 4/1975 | Putti | 425/432 |

FOREIGN PATENTS OR APPLICATIONS

| | | | |
|---|---|---|---|
| 1,905,104 | 8/1970 | Germany | 425/204 |

OTHER PUBLICATIONS

The Declarations of Carter and Putti, respectively; The Decision of the Supreme Court of British Columbia, 10/5/1973, Docket No. 20965/73; Canadian Patent Application S.N. 85194 filed on 6/11/1970; all of which can be found in the patent file of U.S. Pat. No. 3,877,860 issued to George Putti on 4/15/1975.

*Primary Examiner*—Francis S. Husar
*Assistant Examiner*—John McQuade
*Attorney, Agent, or Firm*—Cushman, Darby & Cushman

[57] ABSTRACT

A machine is provided for forming hollow cored concrete slabs in which the hollow core may be produced with shapes other than circular in cross section. The machine may produce a noncircular cross sectioned core by utilizing a novel auger assembly construction which employs an open spiral auger, in the form of a corkscrew, which is supported by an initial core forming member which constitutes a surface of revolution and which conforms substantially to the internal surface of the spiral auger member so as to permit the auger to move over the surface thereof and thus continuously wipe clean the surface and prevent any build up on the initial core forming member. The rotating auger is utilized to compress and form concrete material firstly over the initial core forming member and secondly over the final trowel member, in a manner such that the final slab product will have a core with a cross sectional shape approximating that of the final trowel member. Such cross sectional core shape may be of almost of any desired configuration, and the present invention further contemplates the use of interchangeable final trowel members.

8 Claims, 10 Drawing Figures

CONCRETE SLAB EXTRUDER HAVING A FREE FLIGHT AUGER

BACKGROUND OF THE INVENTION

This invention relates to extruding machines and more particularly to a machine for extruding hollow core sections from extrudable materials of which concrete is an example. For convenience, reference will be made hereinafter to articles formed of concrete, but without limitation thereto since the same principles of the invention may be applied to other materials which can be similarly handled.

Concrete sections or slabs having a plurality of hollow cores running longitudinally therethrough have become extremely popular in the building industry. Prestressed, precast concrete slabs may be used for floor and roof sections and are usually cast in lengths to be fitted together at a particular job site. These slab sections can also be used to form walls whereupon one slab section is stacked upon another and their end sections joined together. When these slabs are utilized in such building construction, one of the main virtues resides in the hollow core. This hollow core not only reduces weight but also provides chambers or ducts for air conditioning, wiring, plumbing and the like.

Machines for extruding a hollow core concrete slab sectin are well known in the art, examples of which are as follows: U.S. Pat. Nos. 3,284,867; 3,159,897; 1,445,724; Canadian Pat. No. 910,030 and Australian Pat. No. 228,818. Of these, all but one, i.e. Canadian Pat. No. 910,030, teach the production of concrete slabs with only a circular core defined therein. The Canadian Patent, on the other hand, as well as the present invention, are intended to permit cores of any desired cross section to be formed within the concrete slab. This is accomplished by the prior art, including the above referred to Canadian patent, by utilizing an initial auger section the shaft or core portion of which is defined by a surface of revolution such as a cone, with the outer surface of the auger being defined by a cylindrical envelope. At the rear portion of this initial auger section is a final trowel member which, since it is stationary and non-rotatable can be of any desired cross section. Thus, in the process of forming the concrete slabs the auger section forces the concrete rearward over the final trowel member causing the core formed in the concrete slab to assume the cross sectional shape of the trowel member, such as one having a rectangular cross section.

Regardless of which of the two devices for forming cores in concrete slabs are used, they both have the same deficiency in that during the operation of the machines for producing the slabs a build up occurs on the initial aguer section along the sides of the flights of the auger and the central portion forming the core thereof. This build up reduces the efficiency of the machine by reducing the volume rate of flow through the machine, thus, undesirably varying the pressure applied in packing the concrete as the slab proceeds off of the rear of the final trowel member. This difficulty can result in defective formation of the concrete slabs as well as a decrease in the efficiency of the apparatus. Also, it has been noted that when the machines are shut down for any repairs or changes it is necessary to remove the auger sections completely clean them to remove this build up, this being a very costly and time consuming task.

SUMMARY OF THE INVENTION

The present invention overcomes the above-described difficulties associated with prior art devices by providing an open spiral auger, much in the form of a corkscrew, which is supported by the initial core forming member which constitutes a surface of revolution and which conforms substantially to the internal surface of the spiral auger member so as to permit the auger to move over the surface thereof and thus continuously wipe clean the surface and prevent any build up on the initial core forming member.

The open spiral auger is secured to an auger drive member for rotation thereby, which in turn is releasably securable to an auger drive shaft, driven by a power source. The rear portion of the initial forming member is preferably tapered so as to mate with a final trowel member, and in such a manner to form a minimal discontinuity between the final diameter of the initial forming member and the configuration of the final trowel member. This blending of the mating portions of the initial forming tube in the final trowel member causes a gradual rise in the pressure applied to the concrete in this transition portion of the device and thus aids in enhancing the uniformity of the density of a concrete slab formed in this manner.

The utilization of an initial forming member which has a configuration which is generated by a surface of revolution corresponding to the shape of the internal surface of the auger flight, permits the auger flight to be supported by this internal surface and thus lending stability to axial rotation of the auger flight, as well as permitting the auger flight to properly and continuously clean the surface of the initial forming member.

The auger drive member preferably, also has an external surface which is generated by a surface of revolution that corresponds to the internal surface of that portion of the auger flight, so as to permit the auger flight to be secured thereto by welding or the like so as to provide the necessary amount of support for rotation of the auger flight in the medium such as concrete, being formed.

A machine utilizing a plurality of auger flights, initial forming members and final trowel members such as are described above, can be used to form any length or width of slab with any desired number of cores therein with the cores being provided with a cross sectional shape to permit the slab to possess the desired strength and weight characteristics. Naturally, the shape of a machine using a plurality of such auger assemblies need not present the augers with their axis aligned in a straight line and only need be aligned to the extent that the material from which an article is being formed will be extruded over the final trowel member to form the desired extrusion configuration, whether it be circular, rectangular, a flat plate, or the like.

BRIEF DESCRIPTION OF THE DRAWINGS:

In the drawings, like reference characters indicate corresponding parts in the different figures.

Novel features of the improved device in accordance with the present invention will be more readily understood from a consideration of the following description, taken together with the accompanying drawings in which a preferred embodiment is illustrated.

DETAILED DESCRIPTION OF THE PREFERRED EMBODIMENT

Figure 1:
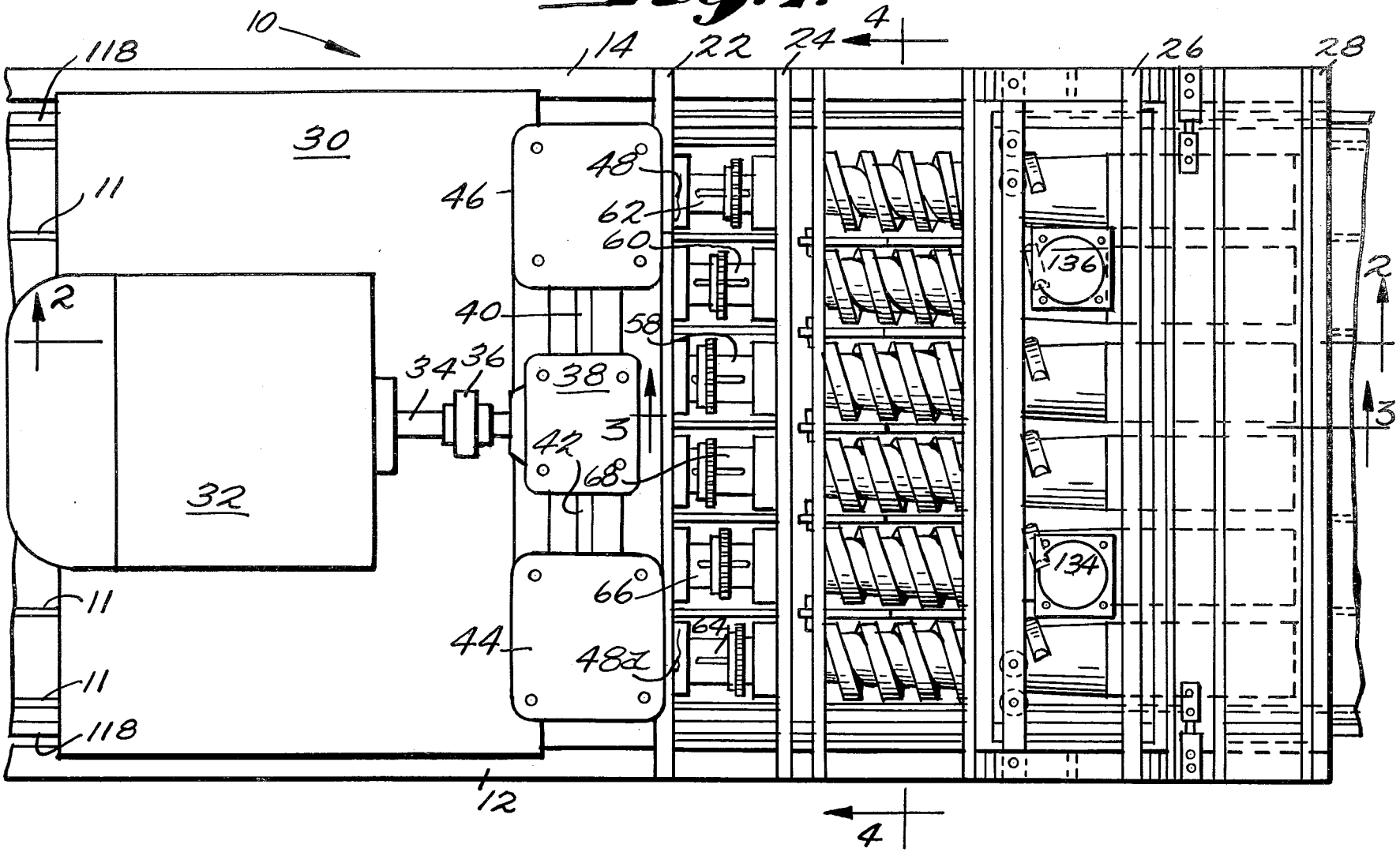
FIG. 1 is a top view of the preferred embodiment of the extruding machine of the present invention in which are disclosed six auger assemblies and forming tubes.

In FIG. 1, the extruding machine is generally designated by the numeral 10. The frame portion of the extruding machine is constructed of two longitudinal channel members 12 and 14, which are tied together by horizontal channel members 16, 18, 20, 22, 24, 26 and 28. The horizontal channel members and longitudinal channel members are preferably constructed of steel. Further, the horizontal channel members are secured to the longitudinal channel members by means well known in the art such as by welding or bolting. Rigidly secured to the front portion of the machine 10 is a supporting platform 30 which is employed to secure a variable speed drive motor 32, which is connected by means of a shaft 34 and a coupling 36 to a primary right angle speed reducer 38. The primary right angle speed reducer 38 employs a hollow output shaft (not shown) through which are inserted input shafts 40 and 42. The input shafts 40 and 42 are operatively connected to the secondary right angle gear reducers 46 and 44, respectively. Because input shafts 40 and 42 are inserted into a hollow output shaft of the primary right angle speed reducer 38, it can be seen that no external couplings from reducer 38 are required. The secondary right angle gear reducer 46 utilizes a right hand worm and worm gear (not shown) so that shaft 48 rotates in a clockwise direction. Gear reducer employs a left hand worm gear and worm gear (not shown) which provides for counter-clockwise rotation of the shaft 48*a*. The shafts 48 and 48*a* are each operatively connected by means of three sprockets and three chain drives to rotate corresponding auger drive shafts. In FIG. 1, auger drive shafts 58, 60, and 62 are rotated clockwise, while auger drive shafts 64, 66 and 68 are rotated in a counter-clockwise direction.

Figure 2:
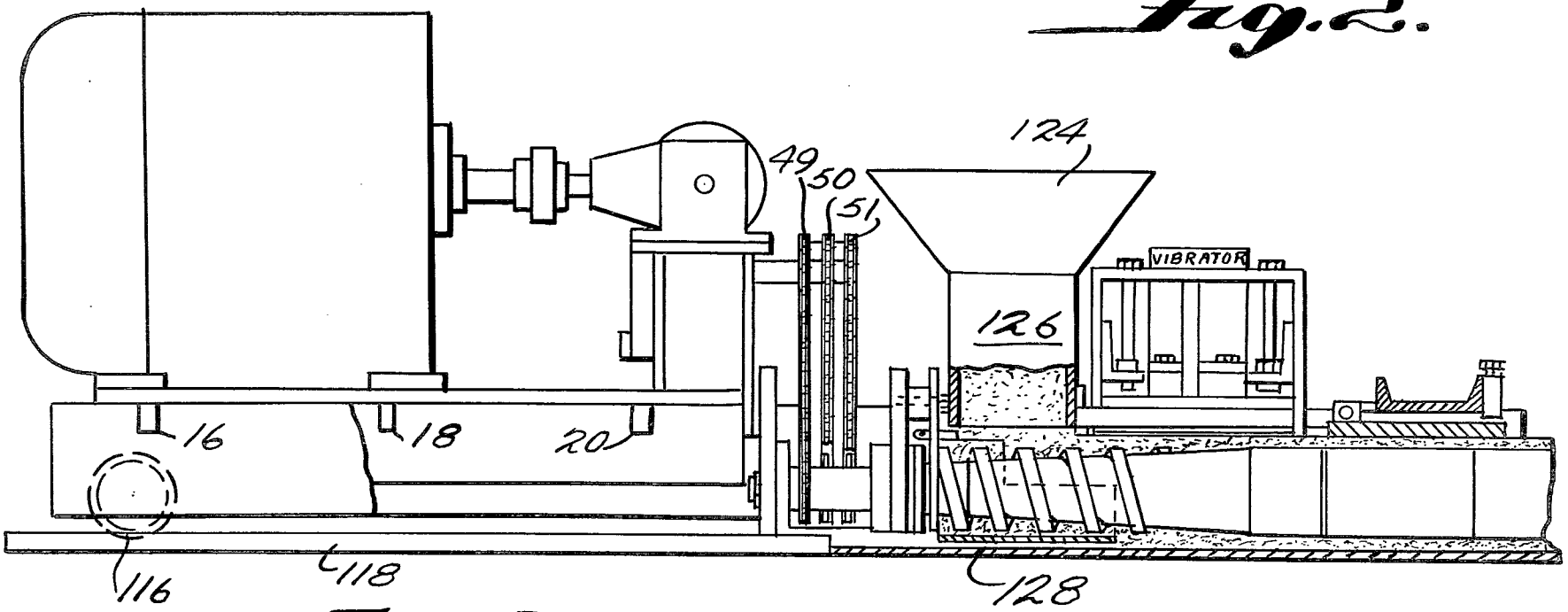
FIG. 2 shows a side view in partial cross section of the embodiment of FIG. 1 taken along lines 2—2.

From a viewing of FIGS. 1 and 2, it can be seen that shaft 48 extending from gear reducer 6 has connected thereto three sprockets 49, 50 and 51, which mesh with chain drives 52, 53, and 54, respectively. For purposes of illustration, the sprocket 49 rotates chain drive 52 which is operatively connected to auger drive sprocket 56, whereupon auger drive shaft 58 is rotatably displaced. In a like manner auger drive shafts 60 and 62 are also rotated. As can be readily appreciated, right angle gear reducer 44 by means of shaft 48*a* utilizes sprockets and chain drives as above described to rotate auger drive shafts 64, 66 and 68 in a similar manner.

Figure 3:
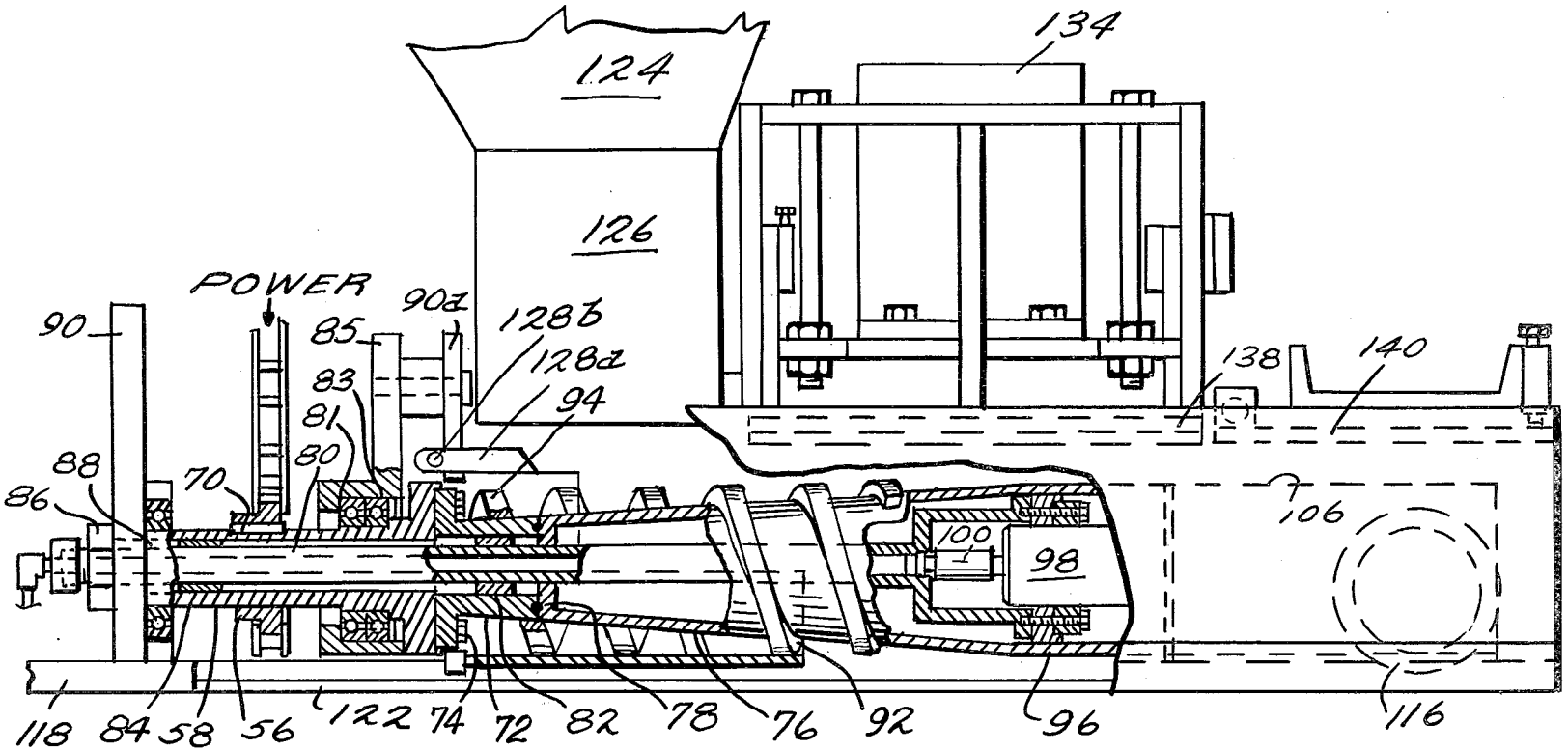
FIG. 3 is a side view in partial cross section of the embodiment of FIG. 1 taken along line 3—3 in which the internal support shaft and supports are diagrammatically illustrated.

Viewing FIG. 3, there is shown a drive sprocket connecting means comprising a key 70 which secures the auger drive sprocket 56 to the auger drive shaft 58. As can be readily appreciated, the remaining auger drive sprockets are connected in a similar manner to their respective auger drive shafts.

Referring to FIG. 3, auger drive shaft 58 is secured to auger drive member 72, preferably by means of a plurality of bolts 74 so that the auger drive member can be separated from the auger drive shaft 58. The initial forming member 76, which is of circular cross section, but can be cylindrical, cone-shaped, or other surface of revolution in configuration, is held against the end portion of auger drive member 72 in a stationary position and in sealing engagement with the auger drive member. Seal 78 is provided between the initial forming member 76 and auger drive member 72 to prevent cement and water from passing between the two. Auger drive member 72 is supported on shaft 80 by means of bushing 82, and auger drive shaft 58 is likewise supported on shaft 80 by means of similar bushings 84. Also, additional support is provided for shaft 58 by bearings 81 and 83 disposed in housing 85 secured to the frame.

Shaft 80 is preferably hollow, for reasons to be explained below, and is secured at one end in a stationary position relative to the initial forming member 76 by means of nut 86 mating with the threaded end portion thereof, which in combination with a shoulder portion 88 of shaft 80 maintains the shaft fixed in support member 90 which is a portion of the basic frame structure of the preferred embodiment. The opposite end of shaft 80 has an expanded portion 91 with a flange 93 thereon for coupling the shaft to rear portion 96 of initial tube forming member 76, in a manner to be described more fully below.

The auger flight 92 is basically an open spiral member resembling a corkscrew and having an internal surface configuration which substantially conforms to the external periphery of initial forming member 76, but which is slightly spaced therefrom in order to permit the auger flight to rotate freely about the initial forming member. The auger flight 92, however, should not be spaced too greatly from the surface of the initial forming member 76 since it will not perform the desired function of continuously scrapping and removing the concrete mixture from the surface of the initial forming member. The forward portion 94 of auger flight 92 is secured to auger drive member 72, preferably by means of welding or the like so as to be rotated thereby. The external surface of auger flight 92 preferably conforms to a cylindrical envelope which is approximately equal in diameter to the rear cylindrical portion 96 of the initial forming member 76. The diameter of this external envelope can be varied, however, dependent upon the configuration of the initial forming tube and the shape of the final trowel member described below.

Figure 5:
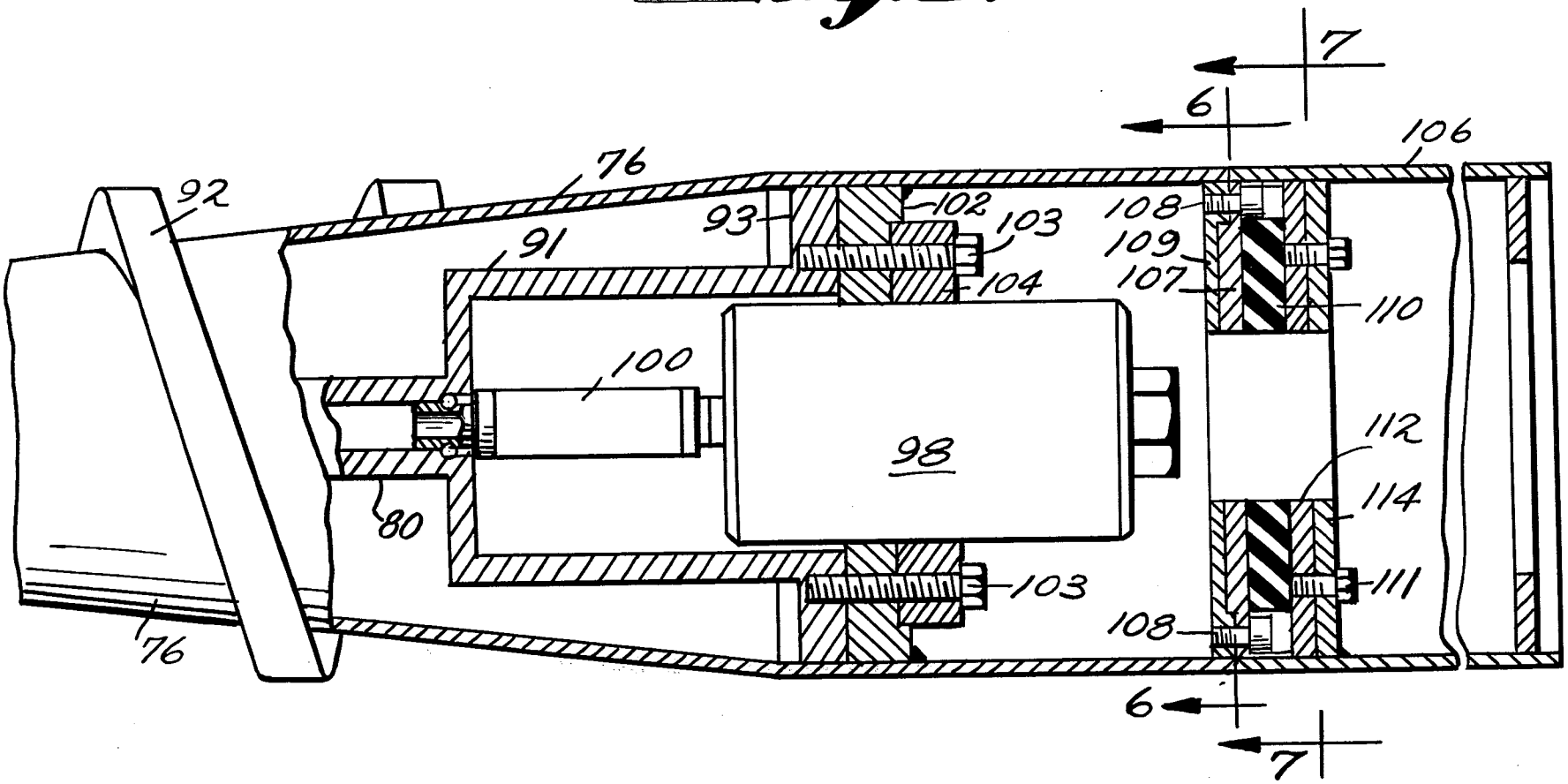
FIG. 5 is an internal cross sectional view of the rear end of the support shaft of the preferred embodiment of FIG. 1 and also shows the connection of the support shaft with the initial forming tube and the final trowel tube, and the internal high frequency vibrator.
Figure 7A:
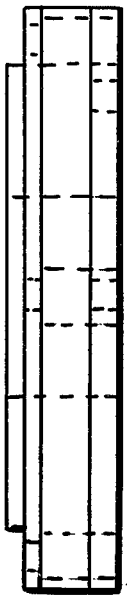
FIG. 7*a* is side elevational view of the rubber shock mount assembly arranged between the initial forming tube and the final trowel tube of the preferred embodiment.
Figure 7B:
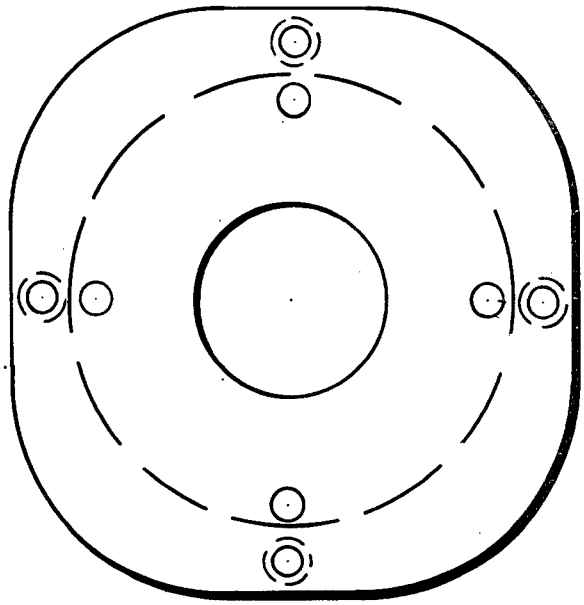
FIG. 7*b* is a cross-sectional view of the final forming tube of the preferred embodiment taken along line 7—7 of FIG. 5.
Figure 6:
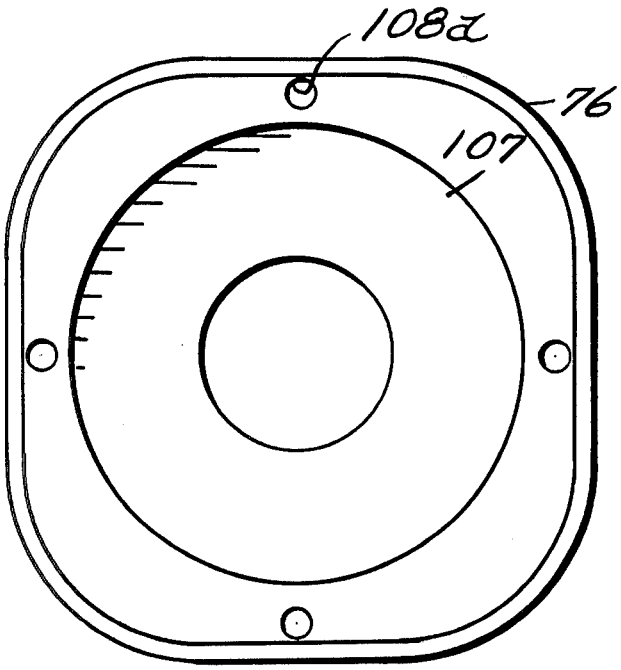
FIG. 6 is a cross sectional view of the preferred embodiment taken along line 6—6 of FIG. 5.

Referring to FIG. 5 located internally of the initial forming member 76 is a high frequency air powered vibrator 98 which is connected by means of a hose clamp 100 through shaft 80 to a source of air for operating the vibrator. Although the vibrator of the preferred embodiment is an air operated one, it may be operated by other well-known means such as hydraulic or electric systems. Vibrator 98 is secured to the initial forming member 76 by means of plates 102 and 104, secured together by means of bolts 103. It is contemplated that plate 102 be welded to forming member 76. The vibrator 98 could be welded or otherwise secured to plate 104. Expanded portion 91 of shaft 80 is also secured to plate 102 by bolts 103. The forming member 76 is secured to the final trowel tube 106 by means of further plates and bolts. Initial forming member 76 and final trowel tube 106 comprise the core forming member which is surrounded by the area 127 as shown in FIG. 3. From viewing FIGS. 5 and 6 it can be seen that trowel tube 106 is secured to plate 107, and by means of bolts 108 is rigidly attached to plate 109. Plate 109 is welded to initial forming member 76. It is to be further noted that a rubber shock mount 110 is disposed between plates 107 and 114 in order to dampen excessive vibrations from vibrator 98 which could pass into the trowel tube portion 106. Bolts 111 secure plate 112 to plate 114, wherein a plate 114 is welded to trowel tube 106. FIG. 6 shows a cross-sectional view taken along line 6—6 of FIG. 5. Viewing FIG. 6, there is noted the cross-sectional shape of the rear portion 96 of initial forming member 76 and the bolt holes 108*a*, adapted to receive the bolts 108 to secure the trowel section 106 to the forming member 76.

Figure 4:
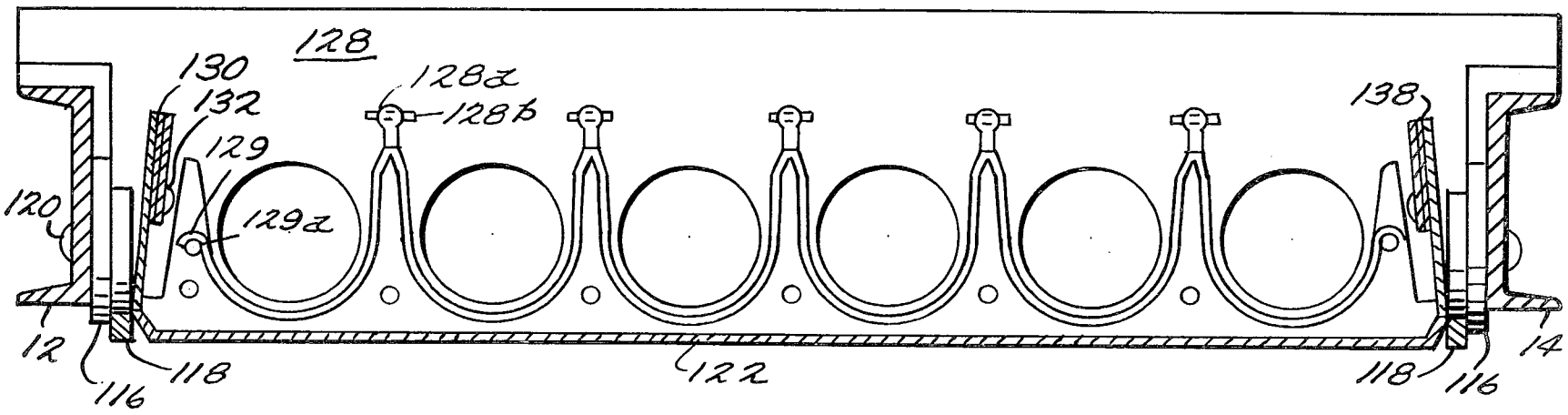
FIG. 4 shows a cross section of the preferred embodiment of FIG. 1 taken along line 4—4 and is illustrative of a continuous auger feed chamber.
Figure 8:
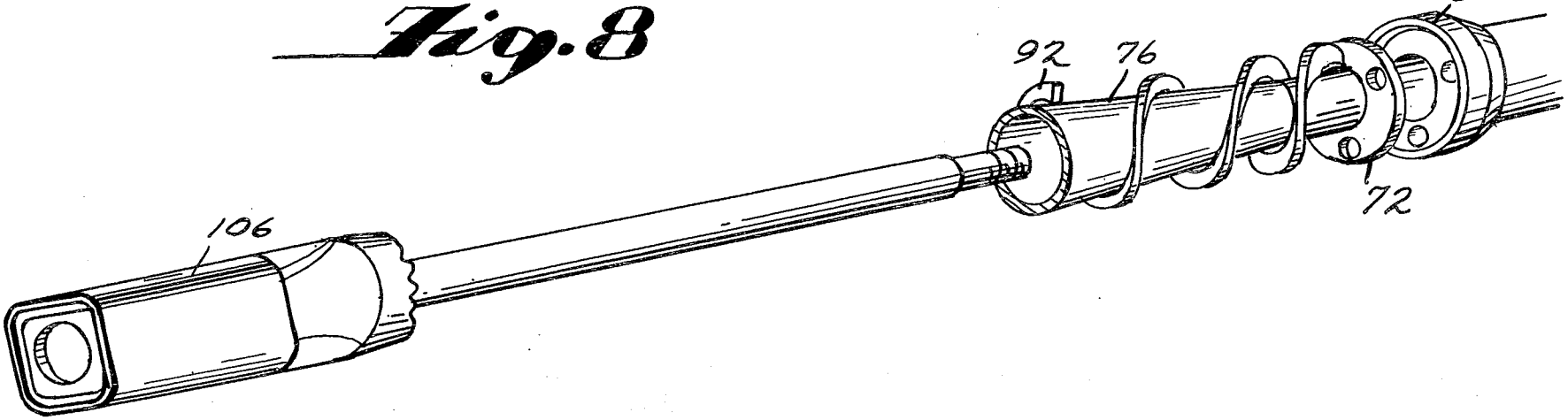
FIG. 8 is an exploded pictorial view of the auger assembly of the preferred embodiment which shows the interrelationship of the auger drive shaft, the flight of augers, the initial forming tube and the internal support shaft which supports the auger drive and auger drive shaft and has one end connected to the initial forming tube and final trowel tube.

FIGS. 1–4 illustrate additional features of the instant invention. It is to be noted that the longitudinal frame channel members 12 and 14 are adapted to travel on steel rails 118 by means of steel wheels 116, which are secured to the longitudinal frame members by means of pins or short axles 120 well known in the art. Displaced between the rails 118 is a surface 122, which in the preferred embodiment is a pallet having a relatively polished or nonstick surface. Located to the rear of the machine is a hopper 124 which will hold concrete and displace same down through a chute 126 and into an auger feed chamber 128. The auger feed chamber 128 is located directly below the chute 126 and is utilized to catch concrete preliminary to its being fed backward by the auger 72. Viewing FIG. 4, a cross section taken substantially along lines 4—4 of FIG. 1, is shown and for sake of clarity, the auger flights 92 have been deleted. Viewing FIGS. 3 and 4, it is to be noted that the auger feed chamber 128 is a continuous series of semicircular sections partially surrounding the auger flight 92, wherein the sections have upturned portions secured to appendages 128*a*. The appendages 128*a* are inserted through the hopper back plate 90*a*, and are secured thereto by means of pins 128*b*. At the extreme ends of the auger feed chamber 128 viewed along a horizontal direction as shown in FIG. 4, are lip portions 129 which are hooked over supports 129*a*, such that auger feed chamber 128 comprises a relatively rigid structure with respect to the frame of the machine. Also secured to the frame are additional side plates 130 which have a half-oval chrome protuberance 132. Located rearwardly of the hopper 124 is a second vibrating means comprising vibrators 134 and 136. Vibrators 134 and 136 are disposed directly above a hammer plate 138, which is utilized to further compact the concrete being passed over and around the augers and forming tubes. Located rearwardly of the vibrators 134 and 136 is a final trowel plate 140 utilized to further smooth the top portion of the concrete slab passed rearwardly from the machine.

Figure 9:
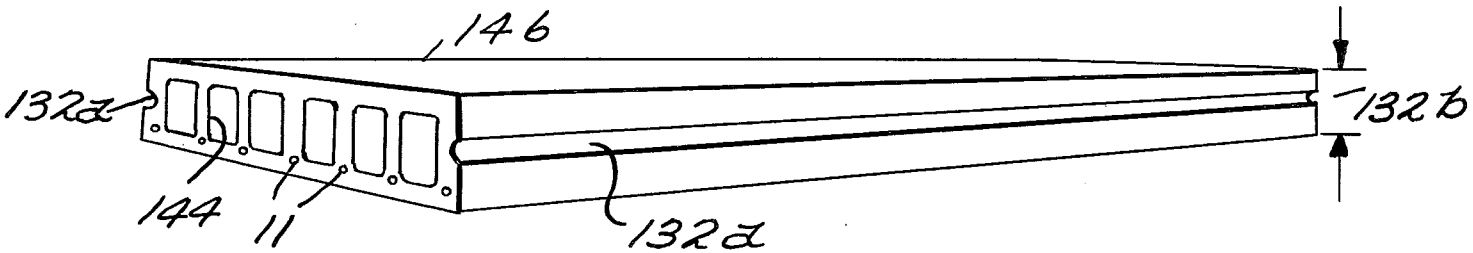
FIG. 9 is an isometric view of a fully extruded hollow cored concrete slab, showing substantially rectangular cross-sectional shaped cores with longitudinal side grooves.

The operation of the machine for extruding prestressed hollow core slabs will now be described. Viewing FIG. 1, it can be seen that reinforcing steel strands 11 may be spaced above the pallet 122 by conventional means. The machine then travels over the pallet 122 in which the pallet provides a track for the extruder and a formed surface for the concrete product. Concrete material is fed into the feed hopper 124 and flows down through the shoot 126 to the six augers 58, 60, 62, 64, 66 and 68. The material is moved into the auger feed chambers 128 by the rotating auger flights 92 which are rotated about initial forming member 76 in close proximity to the surface thereof and which the surface flights are powered by the variable speed drive motor 32 via the auger drive member 72. The material is then fed rearwardly and outwardly by the auger flights 92 from the feed chamber 128 into the core forming area, generally designated at 127. This area 127 is defined by the framework of the machine and surrounds initial forming members 76 and final trowel tube 106 and establishes the outer surfaces of the slab section that is extruded from the machine. The cores or voids 144 in the finished slab 146 are formed by the pressure and vibration created by the auger flights 92, the stationary internally vibrated initial forming members 76 and the top vibrated hammer plate 138. The insides of the voids are trowelled by the final trowel tube 106 to produce the desired final cross sectional shape of the core such as, for example, the rectangular shape shown in FIG. 9. There is also a final trowel plate 140 which smooths the top of the slab section 146 as it passes from the machine. The machine has approximately vertical side plates 130 that contain the concrete material being passed therethrough, in which the side plates 130 provides a framework for the machine and form the vertical sides of the forming chamber. In FIG. 4 there is shown oval-shaped protuberances 132 secured to the side plates 130 which form longitudinal grooves 132*a*, on either side of the slab 146, as the slab is passed outwardly from the rear of the extruding machine. FIG. 9 shows a cored slab section as would be produced by the extruder.

As can be seen from a further viewing of FIG. 5, forming member 76 and final trowel tube 106 can be readily removed from support shaft 74 by unscrewing bolts 103. Because the initial forming member 76 and final trowel tube 106 are stationary with respect to the frame structure, slabs of varying thicknesses may be produced by replacing the side plates 130 with side plates which coincide with raised or lowered plates 138 and 140, and by replacing initial forming members 76 and final trowel tube 106 with corresponding tubes of different cross sectional configuration that provide for cores having a longitudinal axis midway between the top and bottom surfaces of the extruded slab section. In this way, the slab section thickness 132*b* may be increased or decreased as job requirements may dictate, while the basic structure of the extruding machine remains unaltered.

It must be remembered that the foregoing specific embodiment has been described for the purpose of illustrating the principles of the present invention, and the same is subject to modification without departure therefrom. Therefore, the invention includes all modifications within the spirit and scope of the appended claims.

I claim:

1. A machine for forming hollow cored articles, comprising:

a frame;

at least one rotatable auger of open spiral configuration having an internal surface conforming to an envelope produced by a surface of revolution;

means supporting the at least one auger for rotation about its central longitudinal axis in a stationary position relative to the frame;

a power source mounted on the frame for rotating the at least one auger;

an initial non-rotatable core forming member associated with the at least one auger and having a predetermined cross section with an outer surface conforming substantially to the internal surface of the rotatable auger and having a major portion encompassed thereby;

a final core forming trowel member secured in axial alignment to the initial core forming member and establishing the final cross sectional configuration of the core;

means surrounding at least the final trowel member to establish the outer surfaces of the article being formed;

feed chamber means surrounding said rotatable auger for confining said material whereby the auger moves the material toward the final trowel member and means surrounding the latter member; and means mounting the initial core forming member and final trowel member on the frame.

2. A machine as described in claim 1, wherein the at least one rotatable auger of open spiral configuration has an external surface defined by a cylindrical envelope having a diameter substantially equal to the largest diameter of the final core forming member.

3. The machine as described in claim 1, wherein the final trowel member has a cross section that is other than circular.

4. A machine for forming hollow cored concrete slabs on a longitudinally extending surface, said machine comprising:

a main frame having a power source, longitudinal side members and cross support members wherein said main frame further comprises wheel means adapted to engage tracks disposed longitudinally on both sides of said surface;

a hopper in communication with a feed chamber and disposed on the frame;

a plurality of spaced parallel auger assemblies each having (1) a rotatable auger of open spiral configuration having an internal surface conforming to an envelope produced by a surface of revolution, (2) means supporting the auger for rotation about its central longitudinal axis in a stationary position relative to the frame, (3) an initial non-rotatable core forming member associated with the auger and having a predetermined cross section with an outer surface conforming substantially to the internal surface of the auger and having a major portion encompassed thereby, and (4) a final non-rotatable core forming trowel member secured in axial alignment to the initial core forming member and establishing the final cross sectional configuration of the core; a core forming area defined by top, side and bottom members mounted on said frame, the core forming area surrounding said rotatable augers for confining the molding material while each auger moves the material over its final core forming trowel member, each of the auger assemblies having the rotatable auger operatively connected to the power source.

5. A machine as described in claim 4 including:

a first vibrating means located internally of the initial forming member for causing vibration of the initial forming member to aid in the packing of the concrete to form the concrete slab.

6. A machine as described in claim 5, including:

a second vibrating means operatively connected to a vibrating hammer plate means, the hammer plate means and second vibrating means being disposed at least partially above the first vibrating means and adapted to coact with the first vibrating means to compress and displace the concrete around the initial forming member and the final trowel member so that the finished slab has longitudinal internal voids having a cross sectional shape similar to that of the final trowel member.

7. A machine as described in claim 6 including:

protruding means secured to side members of the core forming area, to form a continuous groove along each outside longitudinal edge of the slab being formed.

8. A machine as described in claim 4 wherein each rotatable auger of open spiral configuration has an external surface defined by a cylindrical envelope having a diameter substantially equal to the largest diameter of the final core forming member.

* * * * *